US011600461B2

(12) United States Patent
Schmid et al.

(10) Patent No.: US 11,600,461 B2
(45) Date of Patent: Mar. 7, 2023

(54) SWITCH DEVICE WITH CONTACT COVER

(71) Applicant: Schaltbau GmbH, Munich (DE)

(72) Inventors: Johannes Schmid, Vienna (AT); Daniel Hammerl, Langenzersdorf (AT); Korbinian Kreuzpointner, Schwaig (DE)

(73) Assignee: Schaltbau GmbH, Munich (DE)

( * ) Notice: Subject to any disclaimer, the term of this patent is extended or adjusted under 35 U.S.C. 154(b) by 775 days.

(21) Appl. No.: 16/603,183

(22) PCT Filed: Apr. 6, 2018

(86) PCT No.: PCT/EP2018/000167

§ 371 (c)(1),
(2) Date: Oct. 4, 2019

(87) PCT Pub. No.: WO2018/184727

PCT Pub. Date: Oct. 11, 2018

(65) Prior Publication Data

US 2022/0310342 A1 Sep. 29, 2022

(30) Foreign Application Priority Data

Apr. 6, 2017 (DE) ..... 102017107441.4

(51) Int. Cl.
*H01H 9/30* (2006.01)
*H01H 50/54* (2006.01)
*H01H 9/44* (2006.01)

(52) U.S. Cl.
CPC ..... *H01H 50/546* (2013.01); *H01H 9/302* (2013.01); *H01H 9/443* (2013.01)

(58) Field of Classification Search
CPC ..... H01H 50/546; H01H 33/14; H01H 33/08; H01H 33/18; H01H 33/182; H01H 9/302;
(Continued)

(56) References Cited

U.S. PATENT DOCUMENTS 9,406,465 B1 8/2016 Fasano
2014/0346144 A1* 11/2014 Coquil ..... H01H 1/2041 218/26

FOREIGN PATENT DOCUMENTS

CN 106252164 A 12/2016
DE 19 46 065 U 9/1966
(Continued)

OTHER PUBLICATIONS

Chinese Office Action in related Chinese Patent Application No. 201880037437.9, dated Mar. 15, 2021 (13 pages).
(Continued)

*Primary Examiner* — Bryan R Perez
(74) *Attorney, Agent, or Firm* — Kilpatrick Townsend & Stockton LLP

(57) ABSTRACT

The present invention refers to a switch device with at least one contact point, the contact point having a first contact and a second contact, the first and second contacts being spaced apart from one another in an open position and electrically contacting one another in a closed position, the contact point being assigned an arc blowout device for generating a magnetic blowing field, the blowout field being such that an arc produced when the contact point is opened is blown away from the contact point. In accordance with the invention, at least one of the two contacts is provided with a non-conductive cover on a non-contact-facing side which faces away from the other contact, which cover prevents a base point of the arc from crossing the non-contact-facing side.

13 Claims, 6 Drawing Sheets

Figure 1:
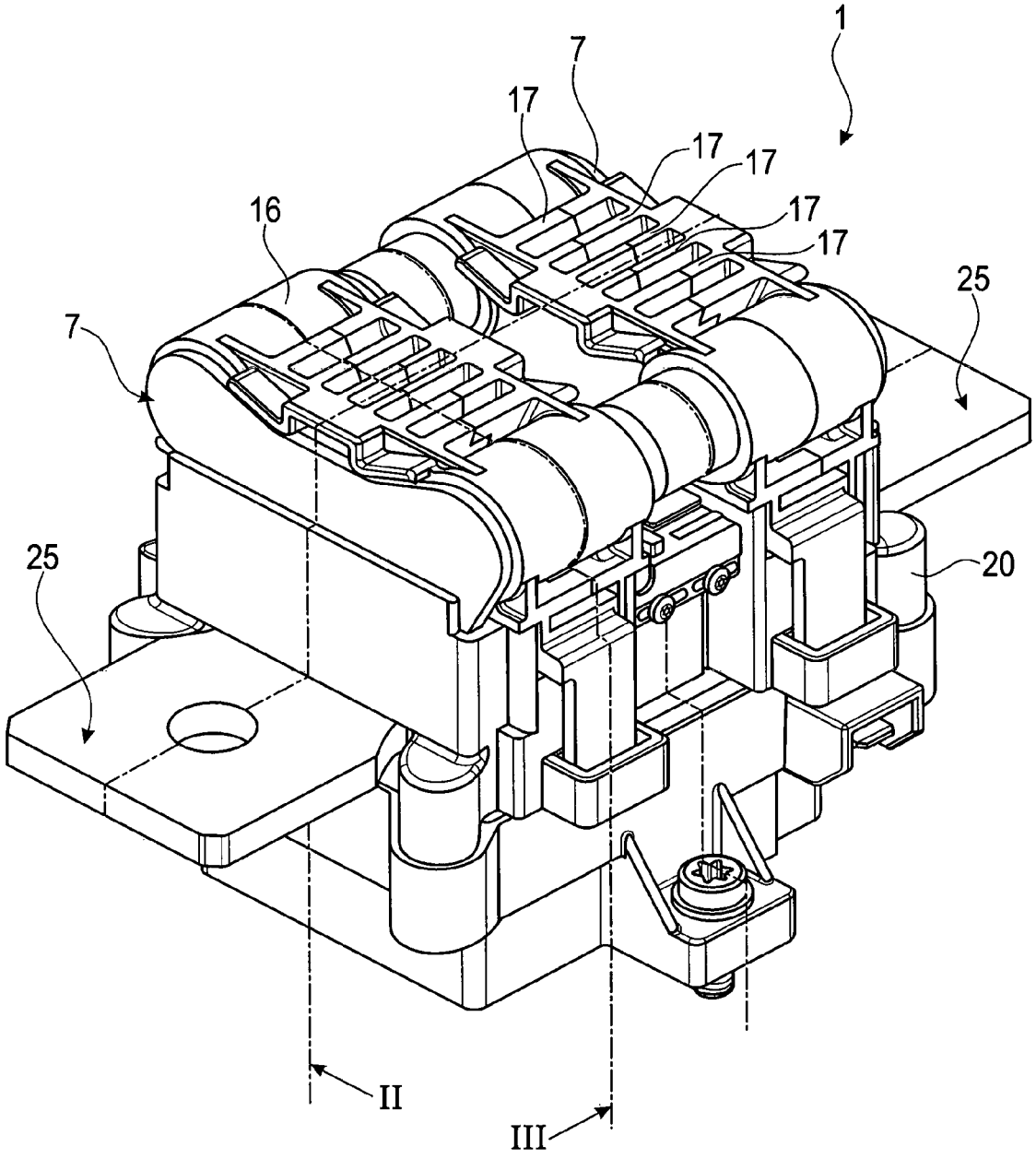

(58) Field of Classification Search
CPC ..... H01H 9/443; H01H 9/36; H01H 9/34; H01H 9/44; H01H 9/46
See application file for complete search history.

(56) References Cited

FOREIGN PATENT DOCUMENTS

| | | | |
|---|---|---|---|
| EP | 1 168 392 | A1 | 1/2002 |
| JP | H08-45411 | A | 2/1996 |
| JP | 2002-352653 | A | 12/2002 |
| JP | 2007-305468 | A | 11/2007 |
| JP | 2014-146502 | A | 8/2014 |
| WO | 2015/144309 | A1 | 10/2015 |

OTHER PUBLICATIONS

International Search Report (ISR) dated Jul. 2, 2018 from the corresponding International Patent Application PCT/EP2018/000167 (six pages).
Notice of Reasons for First Refusal in related Japanese Patent Application No. 2019-553827, dated Dec. 1, 2020 (seven pages).

* cited by examiner

SWITCH DEVICE WITH CONTACT COVER

This application is a US National Phase of PCT/EP2018/000167, filed Apr. 6, 2018, which claims priority to German Application No. 10 2017 107 441.4, filed Apr. 6, 2017, the entireties of which are incorporated by reference herein.

The present invention refers to a switch device according to the preamble of independent claim 1.

A generic switch device has at least one contact point, the contact point having a first contact and a second contact, the first and second contacts being spaced apart in an open position and electrically contacting each other in a closed position. An arc blowout device for generating a magnetic blowout field is assigned to the contact point, whereby the blowout field is designed in such a way that an arc generated when the contact point is opened is blown away from the contact point.

Switch devices according to the preamble of independent claim 1 are known from the state of the art. For example, patent specification EP 0380012B1 describes a current-limiting circuit-breaker with one contact and one mating contact, each located on a pivoting switching arm. In the event of a short circuit, the two switching arms swing apart so that the contact point is opened. The resulting switching arc is driven into an arcing chamber by a magnetic blowout field. To prevent the base point of the switching arc on one of the two arms from running in the wrong direction, part of this switching arm is fitted with a plastic insulating cap. The insulating cap is located on the side of the switching arm facing the second switching arm. The switching arm with the insulating cap is connected via a current path to a terminal contact of the circuit-breaker. The current path serves as an arc guide plate on which the base point of the switching arc jumps when the switching arc is blown away from the contact point, and which guides the switching arc on its way to the arcing chamber and stretches it accordingly.

A further switch device according to the preamble of independent claim 1 is known from WO 2012/076605 A1. This switch device has a double interruption with two contact points. Each contact point consists of a fixed contact and a corresponding movable contact, whereby the two movable contacts are part of a contact bridge aligned parallel to the blowout field. The switch device is designed for bidirectional operation and therefore has arc extinguishing means on both sides of the contact bridge. The switching arc is blown away from the respective contact point in one of the two directions depending on the current direction. The direction of movement of the switching arc thus runs transversely to the longitudinal extension of the contact bridge. In order to guide the switching arc into one of the associated arc extinguishing means, corresponding arc guide plates are provided. These extend both from the respective fixed contact as well as from the associated movable contact on the contact bridge laterally to the outside up to the corresponding arc extinguishing means.

The object of the present invention is to provide a switch device of the generic type with a particularly simple and compact design, while at the same time ensuring reliable extinguishing of the arc. For the purpose of simplicity, the switching arc is referred to as an arc in the following designs.

The object is solved by the features of the independent claim 1. According thereto a solution to the object according to the invention exists in a switch device according to the preamble of independent claim 1 if at least one of the two contacts has a non-conductive cover on a non-contact-facing side which prevents a base point of the arc from crossing the non-contact-facing side.

The solution according to the invention offers the advantage that the arc can be particularly strongly bent and thus stretched, without the danger that the base point of the arc will circle the contact and thus cannot be extinguished. At the same time, the switch device according to the invention remains particularly compact. At the contact provided with the cover according to the invention, no arc guide plate is required to which the base point of the arc jumps when the arc is blown away from the contact point and which serves to stretch the arc and lead it to a corresponding arc extinguishing device. This makes the switch device according to the invention not only particularly compact, but also light and inexpensive to manufacture, since various parts required for conventional switch devices of the generic type can be dispensed with. The side of the covered contact facing the other contact does not have a cover.

The blowout field of the switch device according to the invention is preferably generated purely by permanent magnetism. This means that no electromagnetic blowout coils are required to generate the magnetic blowout field. One or more permanent magnets are preferably used to generate the magnetic blowout field. The permanent magnets can be assigned to pole plates which ensure a homogeneous magnetic field in the required areas. The use of permanent magnets contributes to a compact, lightweight and cost-effective design.

Advantageous embodiments of the present invention are the subject of the subclaims.

According to a particularly preferred embodiment of the present invention, the cover extends from the non-contact-facing side of the respective contact over an edge of the respective contact which runs essentially orthogonal to magnetic field lines of the blowout field to a free end face of the respective contact, so that the end face is also at least partially covered by the cover. This prevents the base point of the arc from running along the end face of the contact. The end face is preferably completely covered by the cover. Further preferably the end face is also orthogonal to the magnetic field lines of the blowout field. If the switch device according to the invention is a switch device with double interruption and a contact bridge aligned parallel to the magnetic blowout field, both ends of the contact bridge are preferably covered by the cover.

According to another particularly preferred embodiment of the present invention, the cover, on a longitudinal side of the contact which is substantially parallel to magnetic field lines of the blowout field, has a recess which is arranged and formed in such a way that the base of the arc runs into the recess when the arc is blown away from the contact point. The non-contact-facing side of the respective contact is thus not partially covered by the cover in this design. This allows the base point of the arc to run into the recess. It is captured, so to speak, in the recess. In front of and behind the recess, the cover preferably extends across the entire width of the respective contact up to its long sides. This embodiment is particularly effective in preventing that the base point of the arc goes around the contact, so to speak, and that the arc cannot be extinguished. It also prevents the base point from breaking out in an undesirable direction. It turned out to be advantageous if the recess is arched. The recess is particularly preferred to be circular in shape. As an alternative, the recess can also be non-arch-shaped, e.g. rectangular. However, a curved recess has proved to be particularly advantageous.

According to another preferred embodiment of the present invention, the cover is made of plastic. Furthermore, it is preferably a high-temperature resistant plastic. The use of polyetherimide (PEI) has proven to be particularly suitable. This ensures a long service life. At the same time, the use of plastic as the material for the cover makes it possible to manufacture the switch device in accordance with the invention at low cost. Other insulating or non-conductive materials are also conceivable as material for the cover. The cover can also be made of ceramic, for example. The cover can either be glued to the respective contact, latched to the contact or otherwise connected to the corresponding contact.

In another particularly preferred embodiment of the present invention, the switch device has a double interruption with two contact points, the first contact of each of the two contact points being a fixed contact, and the second contact of each of the two contact points being part of a common contact bridge aligned parallel to magnetic field lines of the blowout field. With this design, the cover can preferably extend over the entire side of the contact bridge that faces away from the two fixed contacts. The two non-contact-facing sides of the moving contacts thus form a single non-contact-facing side of the contact bridge. Since the blowout field of this embodiment is essentially aligned parallel to the longitudinal extension of the contact bridge, the arc is blown away from the respective contact point at right angles to the contact bridge. The advantageously provided recesses in the cover are thus located on the long sides of the contact bridge.

Furthermore, each contact point is preferably assigned an arc extinguishing means for this embodiment. This allows the arc to be extinguished reliably. The switch device is particularly preferred for bidirectional operation, with the arc extinguishing means having extinguishing elements arranged at both sides of the contact bridge. The arc extinguishing means or its extinguishing elements can also be made of plastic. Here the use of polyamide (PA) is suitable in order to achieve a cooling effect on the arc by evaporation of the polyamide when the arc is applied. The extinguishing elements can, of course, also be made of another suitable material, such as ceramic.

In accordance with a particularly preferred further development of this embodiment, the extinguishing elements are also arranged at the non-contact-facing side of the contact bridge. The extinguishing elements preferably have a certain distance to the contact bridge. Despite its particularly compact design, this embodiment achieves a particularly high extinguishing capacity. The arc can be particularly strongly bent by the magnetic blowout field and thus stretched until it is finally extinguished by the extinguishing elements of the arc extinguishing means.

According to another preferred further development of this embodiment, the fixed contacts are wider than the contact bridge in a direction orthogonal to the magnetic field lines of the blowout field. Further preferably the fixed contacts reach up to the arc extinguishing means and serve at the same time as arc guide plates. At this point it should be emphasized again that no arc guide plate is necessary at the opposite moving contact or at the contact bridge.

According to another particularly preferred embodiment of the present invention, the arc extinguishing means together with the arc blowout device forms a removable assembly without tools, which can be attached to a housing of the switch device by means of snap-in hooks. This makes it particularly easy to maintain the switch device according to the invention or to replace the arc extinguishing and blowout device. The snap-in hooks are preferably elastic tongues, which are also preferably part of the arc extinguishing means or the assembly consisting of arc extinguishing means and arc blowout device. They snap into place with the corresponding snap-in elements of the housing. Furthermore, preferably one bracket on the housing side is provided per snap hook, which surrounds the latched end of the snap hook and prevents unintentional loosening of the latch by attaching a latch, for example by means of sealing, and overstressing of the material caused by overstretching when the latch is loosened. Furthermore, all arc extinguishing means and arc blowout devices at the two contact points are preferably combined into a single removable assembly.

According to another preferred embodiment of the present invention, the switch device according to the invention also has an arcing chamber cover which is designed in such a way that plasma generated by the arc and exiting between the extinguishing elements arranged on the non-contact-facing side of the contact bridge is deflected laterally. The deflection preferably takes place in such a way that the plasma exits at two opposite sides of the switch device. This prevents plasma from escaping from the top of the switch device, such that the distance between the switch device according to the invention and other components arranged above the switch device can be reduced. This makes it considerably easier to install the switch device according to the invention in a corresponding device in which the switch device is to be used.

According to another preferred embodiment of the present invention, the arcing chamber cover can be attached to the assembly consisting of arc extinguishing means and arc blowout device without tools by means of snap-in hooks. The arcing chamber cover can thus be easily replaced or retrofitted to the switch device in accordance with the invention.

An embodiment of the present invention is explained in more detail below using drawings.

Figure 2:
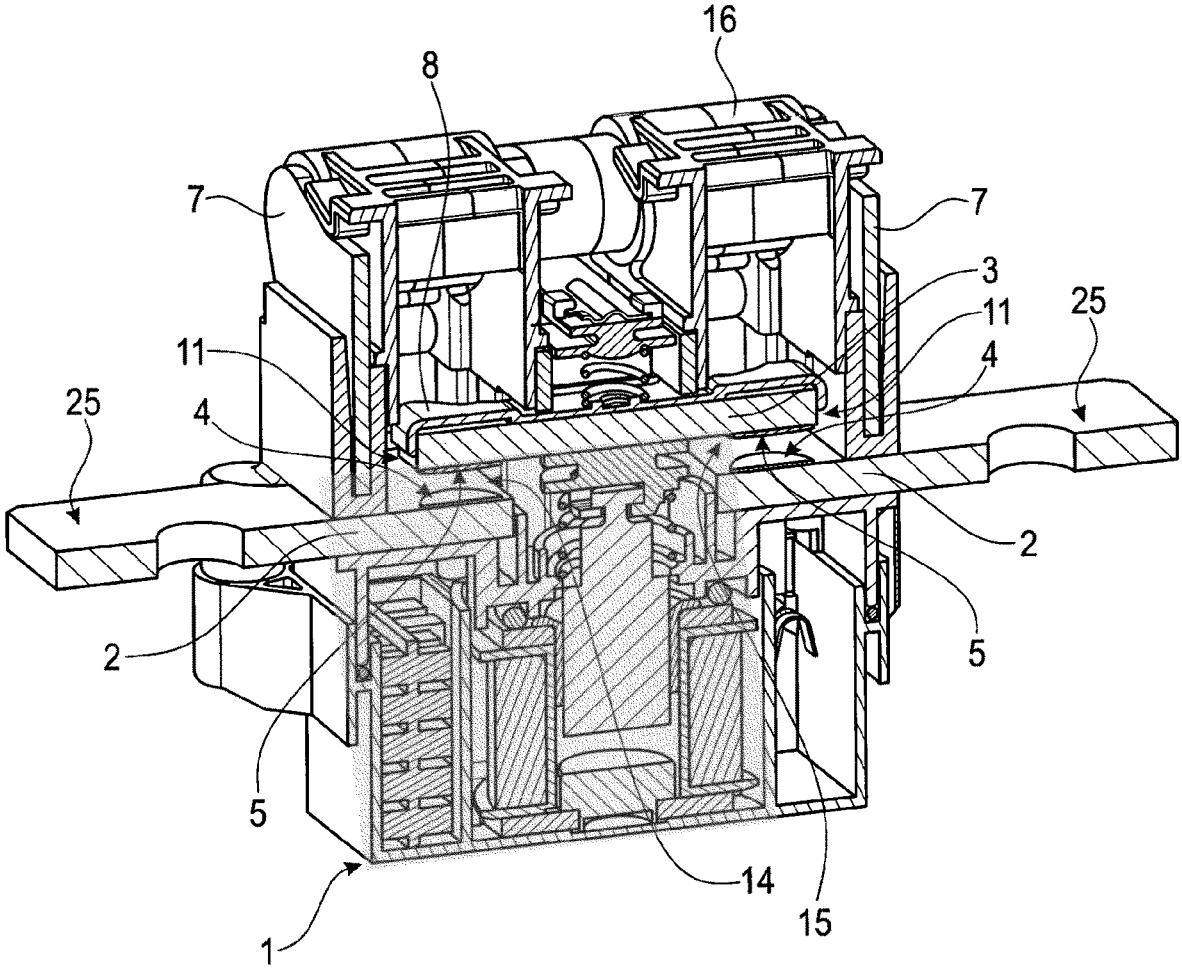
Figure 3:
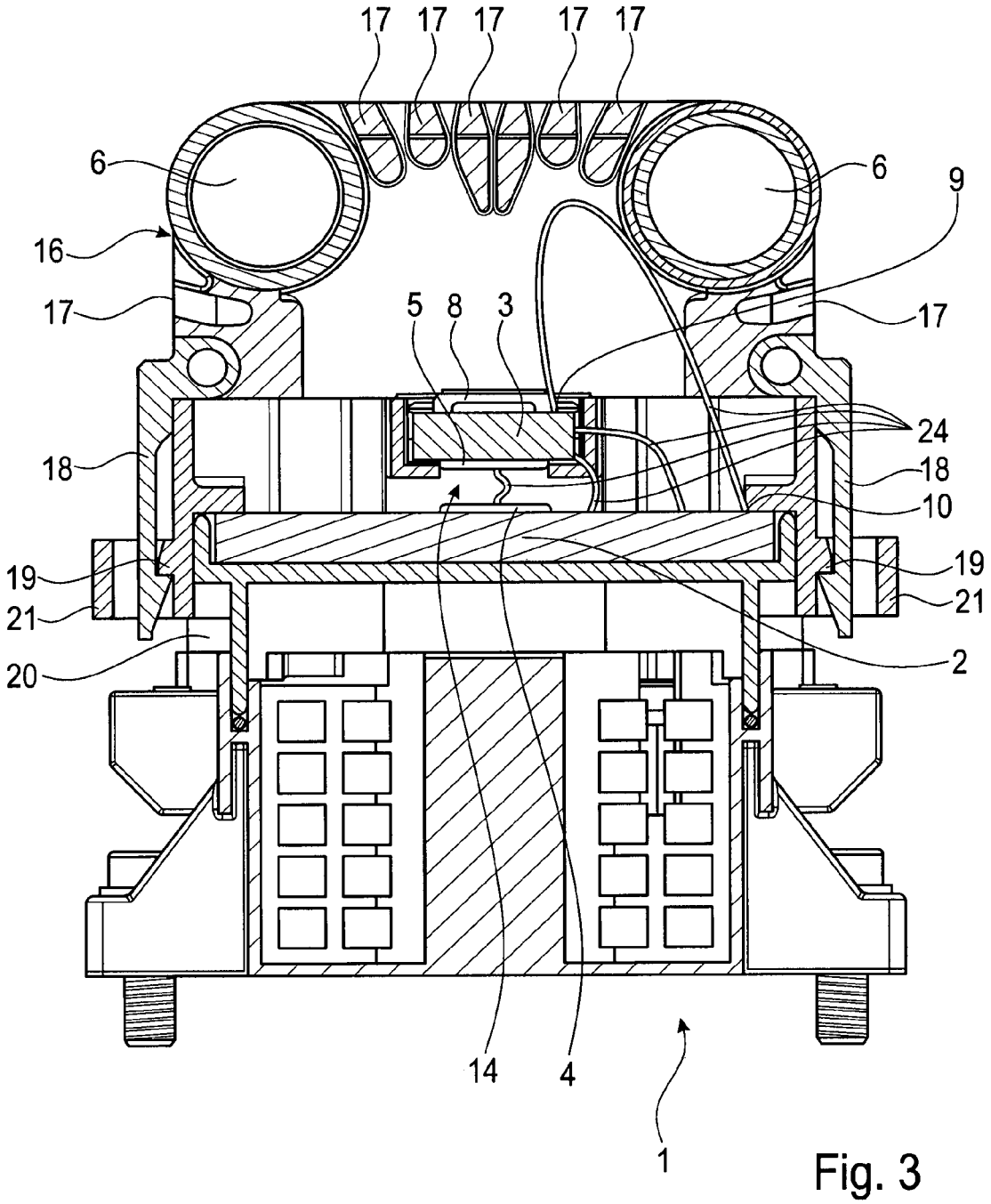
Figure 4:
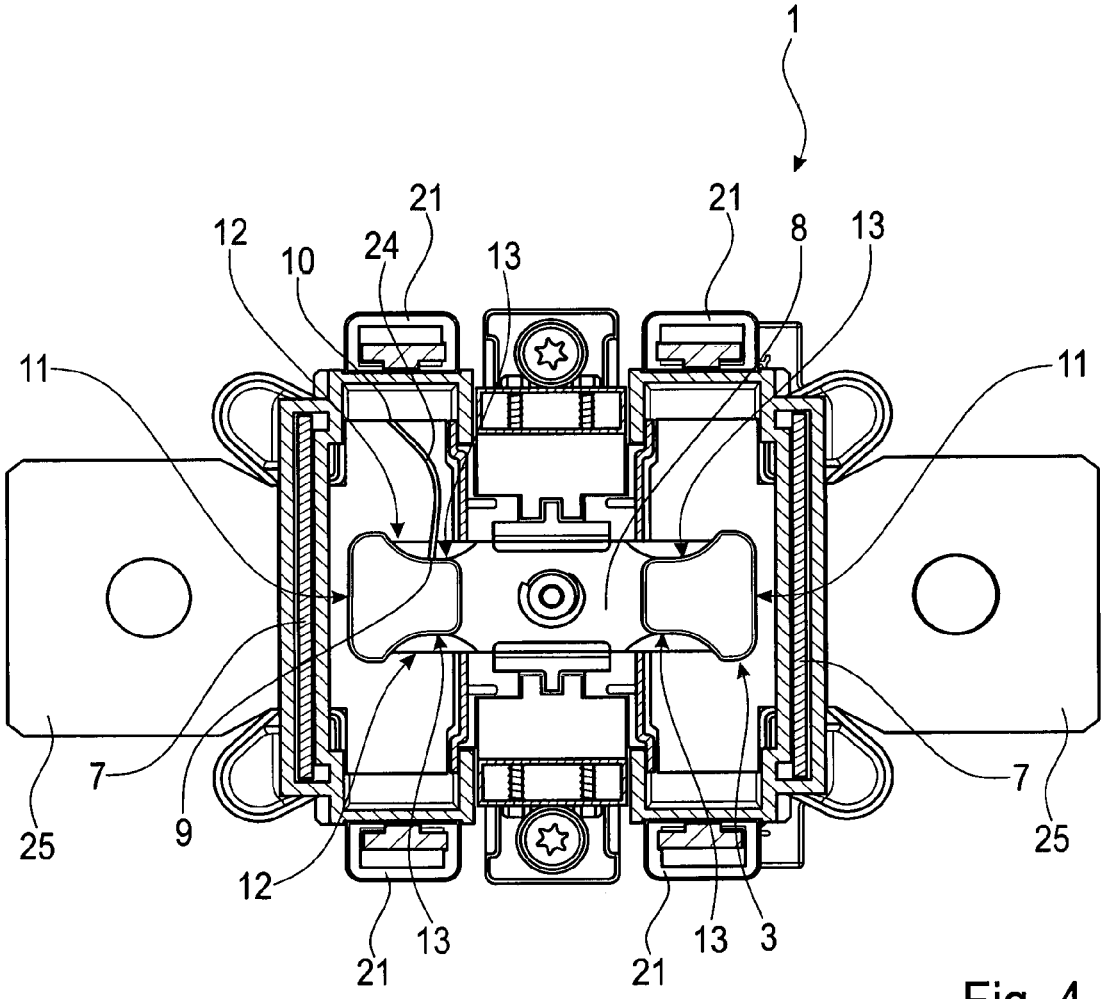
Figure 5:
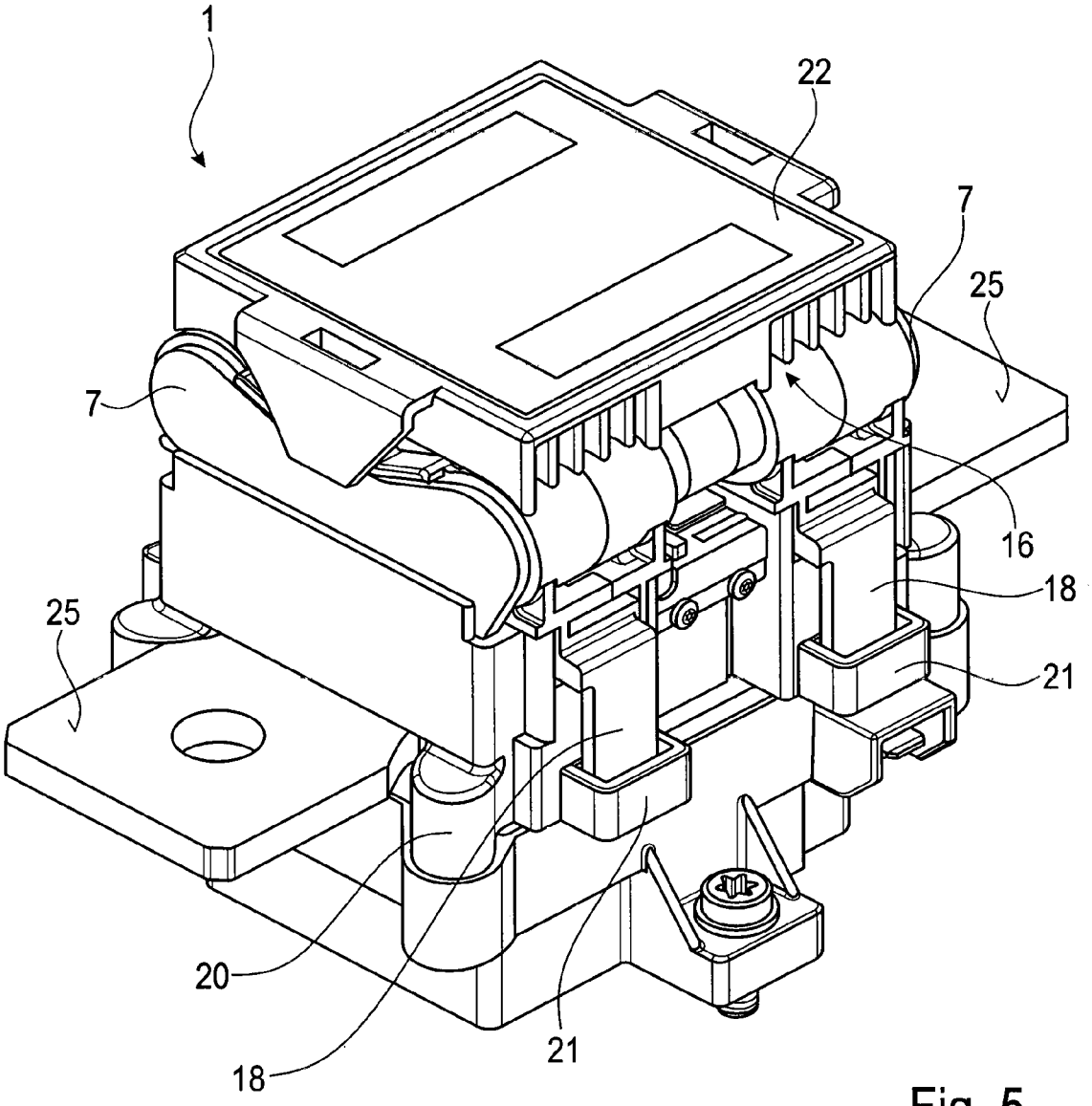
Figure 6:
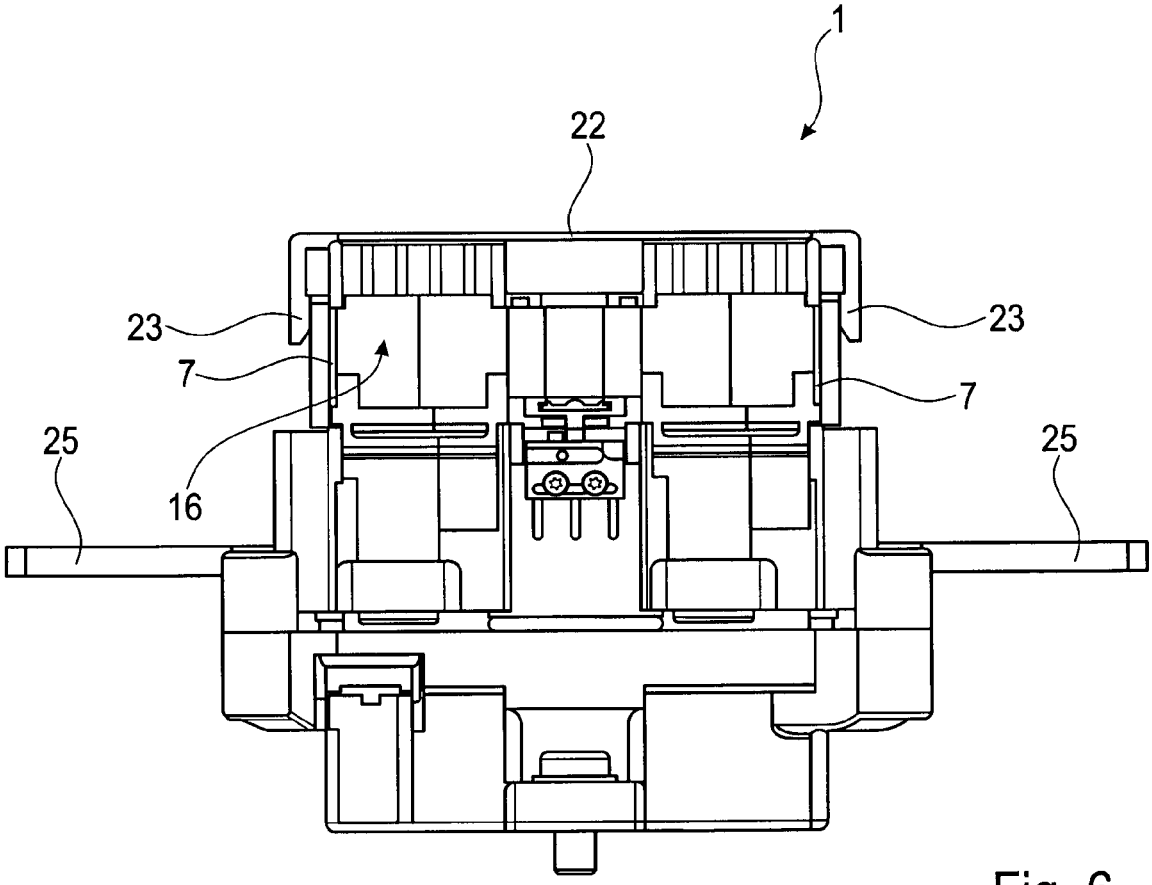

FIG. 1: shows an oblique view of a switch device according to the invention, FIG. 2: shows a perspective longitudinal section through the switch device according to the invention from FIG. 1 along the section line II drawn in FIG. 1, FIG. 3: shows a cross-section of the switch device according to the invention from FIGS. 1 and 2 along the section line III shown in FIG. 1, FIG. 4: shows a top view of the switch device according to the invention from FIGS. 1 to 3 without arc extinguishing means, FIG. 5: shows the representation from FIG. 1 with an additional arcing chamber cover attached to the switch device according to the invention, and FIG. 6: shows a side view of the switch device according to the invention from FIGS. 1 to 5 with arcing chamber cover.

For the following embodiments, identical parts are designated by identical reference numerals. If a Figure contains reference numerals which are not described in detail in the corresponding Figure description, reference is made to preceding or subsequent Figure descriptions.

FIG. 1 shows a perspective view of a switch device 1 according to the invention, showing the housing 20, the two connecting contacts 25 of the switch device and an arc extinguishing means 16 located in the upper part of the switch device according to the invention, the components of which are described in more detail below.

FIG. 2 shows a perspective longitudinal section through the switch device according to the invention along the section line II drawn in FIG. 1. This illustration shows that switch device 1 has a double interruption with two contact points 14 and 15. Each contact point consists of a fixed contact 2 and a moving contact, whereby the two moving contacts are combined to form a common contact bridge 3. The two fixed contacts 2 are led out of the housing of the switch device and thus simultaneously form the two connection contacts 25 of the switch device. Each of the two fixed contacts 2 has a corresponding contact surface 4, which can be brought into contact with an opposite contact surface 5 of contact bridge 3. When the switch device is closed, an electrical contact is established between the fixed contact 2 and contact bridge 3 via the contact surfaces 4 and 5. The electromagnetic drive of contact bridge 3 is shown in the lower part of the Figure and is not relevant for the invention.

FIG. 3 shows a cross-section of the switch device according to the invention along the section line III drawn in FIG. 1. The section was laid through the first contact point 14. The illustration also applies to the second contact point 15. The switch device comprises an arc blowout device consisting essentially of the permanent magnets 6 shown in FIG. 3 and the corresponding pole plates 7 shown in FIGS. 1 and 2. The arc blowout device generates a magnetic blowout field which is aligned parallel to the longitudinal extension of the contact bridge 3, the longitudinal extension of the contact bridge being defined by a mental connection of the two contact points 14 and 15.

When the contact point is opened, a switching arc 24 is created between the contact surfaces 4 and 5, which is blown away from the contact point by the magnetic blowout field transverse to the longitudinal extension of the contact bridge. Depending on the current direction, the switching arc 24 is blown either to the left or to the right as shown in FIG. 3. FIG. 3 shows several positions of the switching arc 24. It can be clearly seen that the switching arc 24 is more strongly bent and thus stretched the further it is blown away from the contact point. The lower base point 10 of the switching arc moves outwards along the fixed contact 2. The fixed contact 2 is considerably wider than the contact bridge 3 and thus also serves as an arc guide plate. The other base point 9 moves from the contact surface 5 via the long side of the contact bridge 3 to the upper side of the contact bridge, which faces away from the fixed contact 2. In order to prevent the base point 9 from moving further and virtually encircling the contact bridge, the non-contact-facing upper side of contact bridge 3 has a non-conductive, insulating cover 8 made of a high-temperature-resistant plastic, e.g. polyetherimide.

The cover 8 is best shown in the plan view from FIG. 4, in which the arc extinguishing device 16 is not shown for the sake of clarity. The cover 8 extends from the non-contact-facing side of the contact bridge via an edge at the free end of the contact bridge which is substantially orthogonal to the magnetic field lines of the blowout field, to the free end face 11 of the contact bridge, so that the end face is also covered by the cover at least in the upper region. This prevents the arc 24 from moving along the end face 11 of the contact bridge. The front cover is provided on both ends 11 of the contact bridge. On the long sides 12 of the contact bridge 3, the cover 8 has two recesses 13 per contact point, which are arranged and designed in such a way that the base point 9 of the switching arc 24 runs into the recess 13 when the arc is blown away from the contact point. The base point 9 of the arc 24 is captured, so to speak, in the recess, effectively preventing the base point from breaking in an undesirable direction. As shown in FIG. 4, the recess is circular in shape.

As FIG. 3 shows, the arc extinguishing device 16 has several extinguishing elements 17 at both sides of the contact bridge and at the non-contact-facing upper side of the contact bridge, which extinguish the switching arc 24. The extinguishing elements 17 are made of plastic and are designed in one piece with a holder for the arc extinguishing device 16. The extinguishing elements can of course also be made of ceramic. Together with the arc blowout device, consisting of the permanent magnets 6 and the pole plates 7, the arc extinguishing device forms a removable assembly without tools, which is attached to the housing 20 of the switch device according to the invention by means of snap-in hooks 18. The snap-in hooks 18 are designed as resilient tongues, the ends of which snap into place with corresponding latching elements 19 of the housing 20. The snap-in connection is secured against overloading of the material caused by overstretching when the snap-in is released by a bracket 21 on the housing side and against unintentional release by attaching a locking device, e.g. by means of a sealing.

As FIGS. 5 and 6 show, the switch device according to the invention can optionally be equipped with an arcing chamber cover 22, which can also be attached to the arc extinguishing device without tools by means of snap-in hooks 23. The arcing chamber cover 22 is arranged on the upper side of the switch device according to the invention and causes a deflection of the plasma, which is generated by the arc and which passes outwards through the extinguishing elements 17 arranged above the non-contact-facing upper side of the contact bridge. The deflection takes place from the side to the outside. As a result, no safety distance must be maintained between the top of the switch device according to the invention and other components or parts. In many cases, the arcing chamber cover 22 facilitates the installation of the switch device 1 according to the invention.

The invention claimed is:

1. A switch device comprising at least one contact point, the contact point having a first contact and a second contact, the first and second contacts being spaced apart from one another in an open position and electrically contacting one another in a closed position, the contact point being assigned an arc blowout device for generating a magnetic blowout field, the blowout field being such that an arc produced when the contact point is opened is blown away from the contact point, wherein at least one of the two contacts has a non-conductive cover on a non-contact-facing side which faces away from the respective other contact, which cover prevents a base point of the arc from crossing the non-contact-facing side, wherein the cover has, on a longitudinal side of the contact with the cover which runs substantially parallel to magnetic field lines of the blowout field, a recess which is arranged and formed in such a way that the base point of the arc runs into the recess when the arc is blown away from the contact point.

2. The switch device according to claim 1, wherein that the switch device has a double interruption with two contact points, the first contact of each of the two contact points being designed as a fixed contact, and the second contact of each of the two contact points being part of a common contact bridge which is aligned parallel to magnetic field lines of the blowout field.

3. The switch device according to claim 2, wherein each contact point is assigned an arc extinguishing device.

4. The switch device according to claim 3, wherein the switch device is designed for bidirectional operation, the arc extinguishing device having extinguishing elements which are arranged on both sides of the common contact bridge.

5. The switch device according to claim 4, wherein the extinguishing elements are also arranged on the non-contact-facing side of the common contact bridge.

6. The switch device according to claim 4, wherein the switch device furthermore has an arcing chamber cover which is designed such that plasma which is generated by the arc and exits between the extinguishing elements arranged on the non-contact-facing side of the common contact bridge is deflected laterally.

7. The switch device according to claim 6, wherein the arcing chamber cover can be fastened without tools by means of snap-in hooks to the assembly consisting of arc extinguishing device and arc blowout device.

8. The switch device according to claim 3, wherein the fixed contacts are wider than the common contact bridge in a direction orthogonal to the magnetic field lines of the blowout field.

9. The switch device according to claim 8, wherein the fixed contacts extend as far as the arc extinguishing device and simultaneously serve as arc guide plates.

10. The switch device according to claim 3, wherein arc extinguishing device, together with the arc blowout device, forms an assembly which can be removed without tools and which can be fastened to a housing of the switch device by means of snap-in hooks.

11. The switch device according to claim 1, wherein the cover extends from the non-contact-facing side of the respective contact via an edge of the respective contact which extends essentially orthogonally to magnetic field lines of the blowout field, to a free end face of the respective contact, so that the end face is also at least partially covered by the cover.

12. The switch device according to claim 1, wherein the recess is of arcuate design.

13. The switch device according to claim 1, wherein the cover consists of plastic.

* * * * *